US008573587B2

(12) United States Patent
Yoshinaga

(10) Patent No.: US 8,573,587 B2
(45) Date of Patent: Nov. 5, 2013

(54) SHEET MATERIAL FEEDING DEVICE AND IMAGE FORMING APPARATUS INCLUDING THE SAME

(75) Inventor: Shinji Yoshinaga, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/529,428

(22) Filed: Jun. 21, 2012

(65) Prior Publication Data

US 2012/0326385 A1 Dec. 27, 2012

(30) Foreign Application Priority Data

Jun. 21, 2011 (JP) ..... 2011-137510

(51) Int. Cl.
*B65H 3/06* (2006.01)

(52) U.S. Cl.
USPC ..... 271/117; 271/118; 271/126; 271/127; 271/145; 271/162

(58) Field of Classification Search
USPC ..... 271/117, 118, 126, 127, 145, 162, 164
See application file for complete search history.

(56) References Cited

U.S. PATENT DOCUMENTS

| | | | | |
|---|---|---|---|---|
| 5,228,677 | A * | 7/1993 | Asakawa | 271/126 |
| 5,897,112 | A * | 4/1999 | Kwag | 271/38 |
| 7,100,915 | B2 * | 9/2006 | Lee et al. | 271/147 |
| 7,523,930 | B2 * | 4/2009 | Kang | 271/152 |
| 7,971,868 | B2 * | 7/2011 | Matsushima et al. | 271/118 |
| 2006/0071399 | A1 * | 4/2006 | Asada et al. | 271/117 |
| 2009/0066009 | A1 | 3/2009 | Matsushima et al. | |
| 2010/0059924 | A1 * | 3/2010 | Shiohara et al. | 271/9.01 |
| 2010/0090394 | A1 * | 4/2010 | You | 271/162 |

FOREIGN PATENT DOCUMENTS

| | | | |
|---|---|---|---|
| JP | 2006-111424 | A | 4/2006 |
| JP | 2008114949 | A | 5/2008 |
| JP | 200962158 | A | 3/2009 |
| JP | 2011-046459 | A | 3/2011 |

OTHER PUBLICATIONS

English Abstract and Machine Translation for JP 2011-046459 A, published Mar. 10, 2011.
English Abstract and Machine Translation for JP 2006-111424 A, published Apr. 27, 2006.

* cited by examiner

*Primary Examiner* — Prasad Gokhale
(74) *Attorney, Agent, or Firm* — NDQ&M Watchstone LLP

(57) ABSTRACT

A sheet material feeding device includes a send-out means that is pressed to contact with the uppermost surface of the sheet material stacked on the sheet material stacking member to move the contact surface in a predetermined direction for sending out the sheet material, a lift up/down means that moves the sheet material stacking member between a feeding position and a separate position, a member to be detected that can move in the up and down direction when the sheet material stacking member moves, a detecting member that can output a detection signal when the member to be detected moves to a predetermined position, and a cassette that supports the sheet material stacking member and can be attached and detached from an apparatus main body. The cassette has an engaging portion for moving the member to be detected to the predetermined position when being attached to the apparatus main body.

15 Claims, 7 Drawing Sheets

SHEET MATERIAL FEEDING DEVICE AND IMAGE FORMING APPARATUS INCLUDING THE SAME

CROSS-REFERENCE TO RELATED APPLICATIONS

This application is based on and claims the benefit of priority from Japanese Patent Application No. 2011-137510 filed on Jun. 21, 2011, the contents of which are hereby incorporated by reference.

BACKGROUND

1. Field

The present disclosure relates to a sheet material feeding device used for an image forming apparatus such as a copier, a printer, a facsimile, or a multifunction apparatus thereof, and an image forming apparatus including the same. In particular, the present disclosure relates to a sheet material feeding device having a lift up/down mechanism for lifting up/down stacked sheet material, and an image forming apparatus including the same.

2. Description of Related Art

An image forming apparatus is equipped with a sheet feed cassette in which paper sheets are stacked, in a detachable manner. When the sheet feed cassette becomes empty, a user draws out the sheet feed cassette from the image forming apparatus, supplies paper sheets and attaches the cassette to the image forming apparatus again. In addition, the image forming apparatus includes a lift up/down mechanism that lifts up the paper sheets stacked on a sheet stacking member toward a pickup roller so that the uppermost surface of the paper sheets contacts with the pickup roller. This lift up/down mechanism lifts up the sheet stacking member on which the paper sheets are stacked by driving force of a lift up/down motor.

In an image forming apparatus of a first related art, when the sheet feed cassette is attached to the image forming apparatus, the lift up/down motor is driven to lift up the sheet stacking member. A detecting member constituted of an optical sensor detects that the uppermost surface of the paper sheets on the sheet stacking member has reached a predetermined position, and then the lift up/down motor is stopped so that the sheet stacking member is stopped. Thus, the pickup roller contacts with the uppermost surface of the paper sheets on the sheet stacking member so that the pickup roller can feed the uppermost paper sheet.

In the image forming apparatus of the above-mentioned first related art, if the lift up/down of the sheet stacking member is blocked by an obstacle or the like so that the sheet stacking member cannot be lifted up or down, the sheet stacking member may be damaged. In addition, because the uppermost surface of the paper sheets on the sheet stacking member does not reach the predetermined position, the lift up/down motor continues to drive. As a result, if the lift up/down motor is a blush motor, overcurrent may flow in the motor so that a problem of a coil break may occur.

Therefore, there is known an image forming apparatus of a second related art that can solve the above-mentioned problem. The image forming apparatus of the second related art includes a reach detection means that detects that a sheet stacking means reaches an end position of a lift-up range, and a lift up/down means that urgently stops lifting up/down of the sheet stacking means if the reach detection means does not detects the sheet stacking means within a predetermined time set by a count means when the sheet stacking means is lifted up/down. With this structure, if the lift up/down of the sheet stacking means is blocked by an obstacle or the like, the lifting up/down of the sheet stacking means is stopped urgently so that breakage of the sheet stacking means or damage to the obstacle can be reduced.

The image forming apparatus of the second related art has a structure for urgently stopping lifting up/down of the sheet stacking means if the reach detection means does not detects the sheet stacking means within a predetermined time in order to reduce breakage of the sheet stacking means or damage to the obstacle. However, with this structure, if the reach detection means is broken and does not work normally, the lift up/down means cannot be stopped, and hence there is a problem that an actuator such as a motor of the lift up/down means continues to drive.

SUMMARY

It is an object of the present disclosure to provide a sheet material feeding device and an image forming apparatus including the same, in which good or bad of the detecting member is decided prior to feeding sheet material so that damage to a lift up/down means is prevented.

A sheet material feeding device according to an aspect of the present disclosure includes a sheet material stacking member that can move sheet material in up and down direction, a send-out means that is pressed to contact with the uppermost surface of the sheet material stacked on the sheet material stacking member so as to move the contact surface in a predetermined direction for sending out the sheet material, a lift up/down means that moves the sheet material stacking member between a feeding position in which the uppermost surface of the sheet material contacts with the send-out means and a separate position in which the uppermost surface of the sheet material is apart from the send-out means, a member to be detected that can move in the up and down direction when the sheet material stacking member moves, a detecting member that can output a detection signal when the member to be detected moves to a predetermined position, and a cassette that supports the sheet material stacking member in a movable manner and can be attached and detached from an apparatus main body. The cassette has an engaging portion for moving the member to be detected to the predetermined position when being attached to the apparatus main body.

In addition, a sheet material feeding device according to another aspect of the present disclosure includes a sheet material stacking member that can move sheet material in the up and down direction, a send-out means that is pressed to contact with the uppermost surface of the sheet material stacked on the sheet material stacking member so as to move the contact surface in a predetermined direction for sending out the sheet material, a lift up/down means that moves the sheet material stacking member between a feeding position in which the uppermost surface of the sheet material contacts with the send-out means and a separate position in which the uppermost surface of the sheet material is apart from the send-out means, a member to be detected that can move in up and down direction when the sheet material stacking member moves, a detecting member that can output a detection signal when the member to be detected moves to a predetermined position, a control portion that stops drive of the lift up/down means based on a detection signal output from the detecting member when the sheet material stacking member moves to the feeding position for sending out the sheet material, and a cassette that supports the sheet material stacking member in a movable manner and can be attached and detached from an apparatus main body. The cassette has an engaging portion for moving the member to be detected to the predetermined position when being attached to the apparatus main body, and the control portion decides whether or not the detection signal is output from the detecting member when the engaging portion moves the member to be detected to the predetermined position.

Other objects of the present disclosure, and specific advantages obtained by the present disclosure will be apparent from the following description of an embodiment.

DETAILED DESCRIPTION OF THE PREFERRED EMBODIMENTS

Hereinafter, an embodiment of the present disclosure is described with reference to the attached drawings, but the present disclosure is not limited to this embodiment. In addition, a use of the disclosure and terms in this specification should not be interpreted as a limitation.

Figure 1:
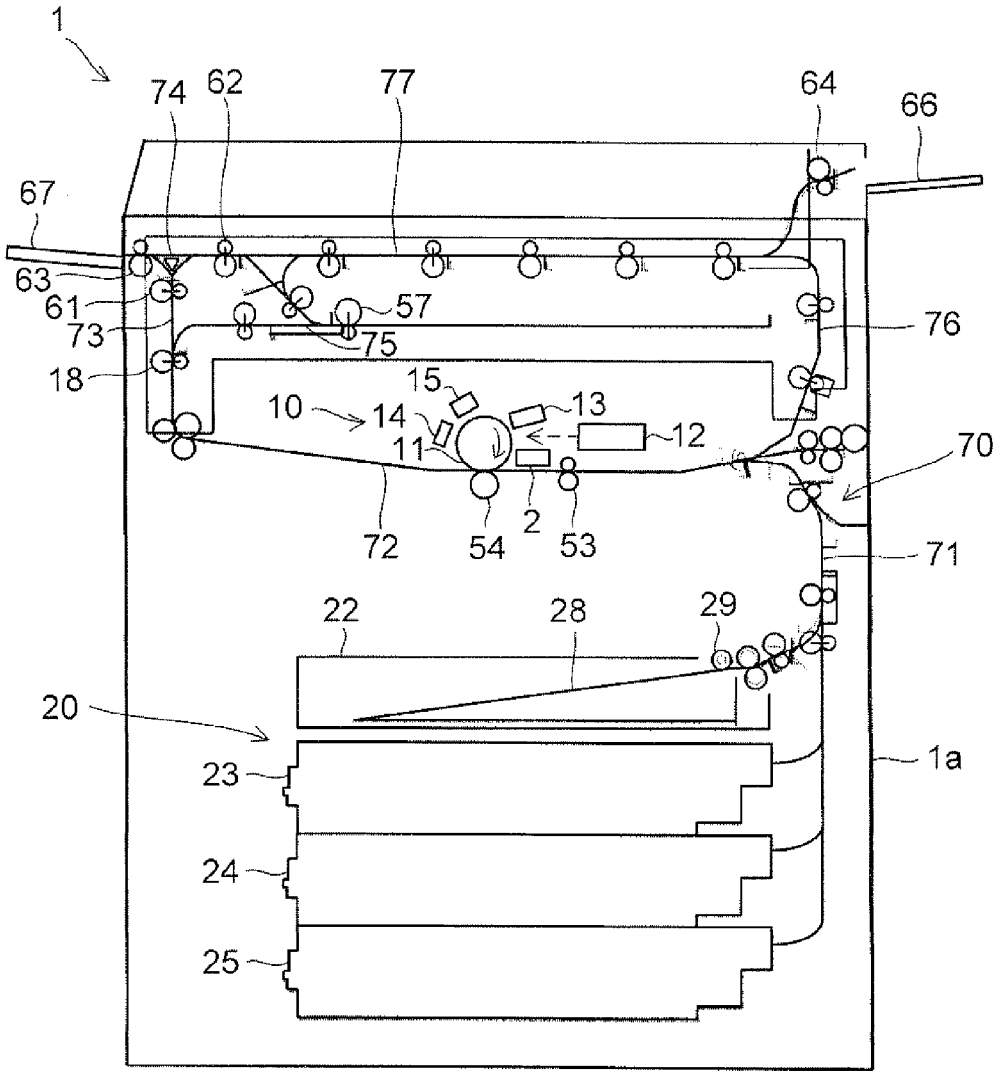
FIG. 1 is a schematic diagram illustrating an image forming apparatus including a sheet feeding device of the present disclosure.

FIG. 1 is a schematic diagram illustrating an image forming apparatus according to the present disclosure. An image forming apparatus 1 includes a rectangular apparatus main body 1*a* and an image forming portion 10 disposed in a substantially middle portion in the apparatus main body 1*a*. The image forming portion 10 includes a photosensitive unit 11 as an image carrier unit, and further includes a charging unit 13, an exposing unit 12, a developing unit 2, a transfer roller 54, a cleaning unit 14, and a static eliminator 15, which are disposed around the photosensitive unit 11 in a rotation direction thereof (arrow direction in the diagram). The developing unit 2 is supplied with toner from a toner container (not shown). The cleaning unit 14 collects toner remaining on the surface of the photosensitive unit 11, and the static eliminator 15 eliminates charge remaining on the surface of the photosensitive unit 11.

When the surface of the photosensitive unit 11 is uniformly electrified by the charging unit 13 at a predetermined polarity and potential, the exposing unit 12 forms an electrostatic latent image of an original image on the photosensitive unit 11 based on image data of the original read by a document reading device (not shown).

The developing unit 2 supplies charged toner to the surface of the photosensitive unit 11 and develops the electrostatic latent image on the photosensitive unit 11 so as to form a toner image. The toner image is transferred onto a paper sheet as a sheet material by the transfer roller 54. After the toner image is transferred onto the paper sheet, the toner remaining on the surface of the photosensitive unit 11 is cleaned and collected by the cleaning unit 14, and further, charge remaining on the surface of the photosensitive unit 11 is eliminated by the static eliminator 15.

A sheet feeding device 20 includes sheet feed cassettes 22 to 25, and the like. The sheet feed cassettes 22 to 25 are arranged in the vertical direction in the bottom portion of the apparatus main body 1*a*. The sheet feed cassettes 22 to 25 are disposed in a detachable manner in the front part of the apparatus main body 1*a*. The sheet feed cassette is drawn out from the apparatus main body 1*a* to supply paper sheets, and is pushed and inserted into the apparatus main body 1*a* after supplying paper sheets. The paper sheets are stacked on a sheet stack tray 28 of the sheet feed cassette 22, and paper sheets on the sheet stack tray 28 are fed out to a paper sheet conveying portion 70 by a pickup roller 29.

The paper sheet conveying portion 70 is provided for conveying paper sheets in the apparatus main body 1*a*, and includes a sheet transport path 71, an image forming transport path 72, a post-fixing transport path 73, a branch transport path 74, a reverse delivery transport path 77, a reverse transport path 75, and a retransport path 76.

The sheet transport path 71 is a transport path from the sheet feeding device 20 to a registration roller pair 53, and is formed to extend upward from the sheet feeding device 20 in the right part of the apparatus main body 1*a* and to curve to the left. The registration roller pair 53 is disposed on the right side of the transfer roller 54, and feeds out the paper sheet to the transfer roller 54 in synchronization with timing when the toner image is transferred onto the paper sheet.

The image forming transport path 72 is a transport path from the registration roller pair 53 to a fixing unit 18, and is formed to extend substantially horizontally in the apparatus main body 1*a* and to curve upward. In the image forming transport path 72, there are disposed the image forming portion 10 and the fixing unit 18. The image forming portion 10 transfers the toner image onto the paper sheet, and the fixing unit 18 fixes the toner image on the paper sheet after transferring onto the paper sheet.

The post-fixing transport path 73 is a transport path extending from the fixing unit 18 upward to the branch transport path 74. The paper sheet on which the toner image is fixed is transported along the post-fixing transport path 73 to the branch transport path 74.

The branch transport path 74 is a transport path for transporting the paper sheet on which the toner image is fixed to the reverse delivery transport path 77 or a second delivery tray 67. The branch transport path 74 includes a transport path curving to the right from a transport roller pair 61 to reach the reverse delivery transport path 77 via a transport roller pair 62, and a transport path curving to the left from the transport roller pair 61 so as to deliver the paper sheet to the second delivery tray 67 by a second delivery roller pair 63, and a transport path extending from the transport roller pair 62 horizontally to the second delivery roller pair 63 so as to deliver the paper sheet in the reverse delivery transport path 77 to the second delivery tray 67.

The reverse delivery transport path 77 is a transport path for delivering the paper sheet to a first delivery tray 66 or transporting a reversed paper sheet for forming a toner image on the backside of the paper sheet.

The reverse transport path 75 is provided for reversing the transport direction of the paper sheet so as to transport the paper sheet to the reverse delivery transport path 77. The reverse transport path 75 branches from the post-fixing transport path 73 and extends to the right toward a reverse roller pair 57, and further extends upward from the reverse roller pair 57 like a U shape to join the reverse delivery transport path 77.

The retransport path 76 is provided for transporting the paper sheet reversed by the reverse transport path 75 from the reverse delivery transport path 77 to the image forming transport path 72. The retransport path 76 is formed to branch from the reverse delivery transport path 77 downward and joins the sheet transport path 71.

The paper sheet fed from the sheet feeding device 20 is transported upward in the sheet transport path 71 and is transported to the transfer roller 54 by the registration roller pair 53 at timing of transportation so that the transfer roller 54 transfers the toner image onto the paper sheet. The paper sheet to which the toner image is transferred is transported to the fixing unit 18 along the image forming transport path 72 and is heated and pressed by the fixing unit 18 so that the toner image is melted and fixed to the paper sheet. The paper sheet on which the toner image is fixed passes through the post-fixing transport path 73 and the branch transport path 74 and is delivered to the first delivery tray 66 by the transport roller pair 62 and a first delivery roller pair 64. Otherwise, the paper sheet on which the toner image is fixed passes through the post-fixing transport path 73 and the branch transport path 74 and is delivered to the second delivery tray 67 by the second delivery roller pair 63.

When double-sided printing is performed, paper sheet fixed in the fixing unit 18 is transported from the post-fixing transport path 73 to the reverse transport path 75. After the leading edge of the paper sheet passes the reverse roller pair 57 in the reverse transport path 75, the reverse roller pair 57 is rotated reversely at a predetermined timing so that the paper sheet is switched back so that the paper sheet is sent to the reverse delivery transport path 77 with the printed surface upside down. The reversed paper sheet is transported again to the sheet transport path 71 from the reverse delivery transport path 77 via the retransport path 76. The image forming portion 10 transfers a toner image onto the backside of the paper sheet transported to the image forming transport path 72 via the sheet transport path 71, and the fixing unit 18 melts and fixes the toner image. Then, the paper sheet passes the transport path selected by the branch transport path 74 and is delivered to the first delivery tray 66 or to the second delivery tray 67.

Figure 2:
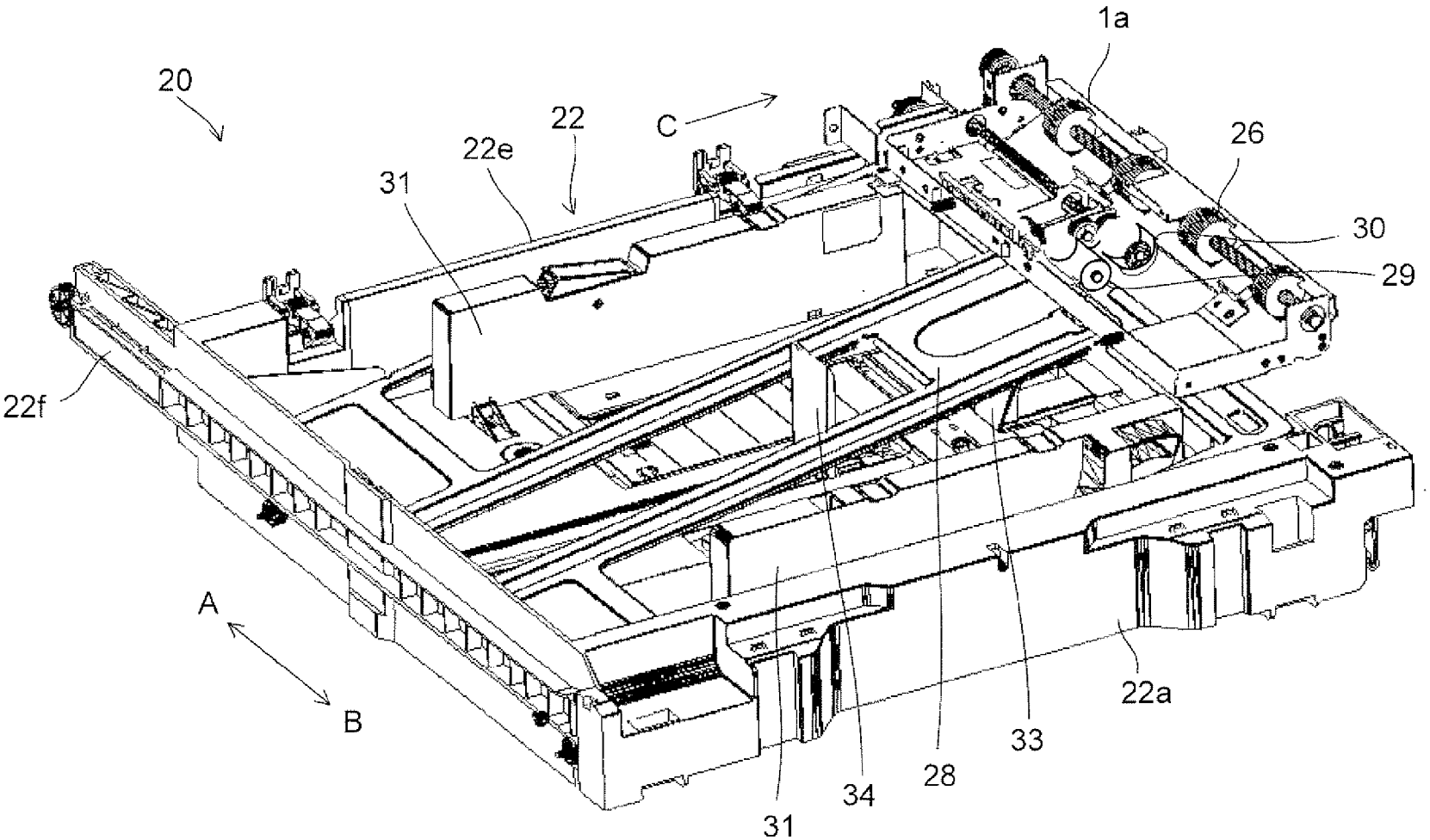
FIG. 2 is a perspective view illustrating the sheet feeding device of the present disclosure.

FIG. 2 is a perspective view illustrating the sheet feeding device 20 as a sheet material feeding device. Note that in the following description, a structure and operation of the sheet feed cassette 22 and its vicinity illustrated in FIG. 1 are described as the sheet feeding device 20. A structure and operation of the sheet feed cassettes 23 to 25 and their vicinity are the same as those of the sheet feed cassette 22 and its vicinity, and description thereof is omitted.

The sheet feed cassette 22 has an open upper face, a front face portion 22*a*, a rear face portion 22*e*, and side face portions, which constitute a flat box shape. The paper sheets are put into the sheet feed cassette 22 from the upper face and are stacked in it. Guide ribs 22*f* disposed on both side face portions of the sheet feed cassette 22 (right guide rib 22*f* is not shown) are engaged with rails (not shown) in the apparatus main body 1*a* (see also FIG. 1), and the sheet feed cassette 22 is moved to slide horizontally in an arrow A direction. Then, the sheet feed cassette 22 is attached to the apparatus main body 1*a*. On the other hand, when the guide rib 22*f* is moved to slide in an arrow B direction, the sheet feed cassette 22 can be drawn out from the apparatus main body 1*a*. Note that it is possible to adopt a structure in which the sheet feed cassette 22 is attached and detached in a transport direction C.

The sheet feed cassette 22 includes the sheet stack tray 28 as a sheet stacking member, a pair of width direction cursors 31 and 31, and a lifting plate 33. The pickup roller 29 as a send-out means, a sheet feed roller pair 30, and a plurality of transport roller pairs 26 are disposed on an attachment frame (formed in the apparatus main body 1*a*).

The sheet stack tray 28 is supported pivotally around a rotation axis (not shown) at the upper stream side of the paper sheet transport direction C to swing vertically in the sheet feed cassette 22. Paper sheets are stacked on this sheet stack tray 28. The pair of width direction cursors 31 and 31 is disposed in the sheet feed cassette 22 so as to sandwich the sheet stack tray 28 and abuts both side surfaces of the paper sheet stack in the width direction of the paper sheet. A position of the paper sheet stack on the sheet stack tray 28 is determined by the width direction cursors 31 and 31 and a rear end cursor 34 disposed in a movable manner in the transport direction C on the bottom surface of the sheet feed cassette 22.

The lifting plate 33 is disposed below the sheet stack tray 28 and is rotated by a sheet feed cassette side gear (not shown). When the sheet feed cassette 22 is attached to the apparatus main body 1*a*, the sheet feed cassette side gear engages with an apparatus main body side gear connected to a lift up/down motor (not shown). When the lift up/down motor is driven to rotate in one direction, the lifting plate 33 is lifted gradually, and the sheet stack tray 28 abutting the tip of the lifting plate 33 is lifted. When the sheet stack tray 28 is lifted, the paper sheets stacked on the sheet stack tray 28 are pressed to the pickup roller 29. On the other hand, when the lift up/down motor is driven to rotate in the other direction, the lifting plate 33 is gradually lowered so that the sheet stack tray 28 is lowered. Note that the lifting plate 33 and the gears for rotating the lifting plate 33 constitute a lift up/down mechanism.

The pickup roller 29 sends out the uppermost one or more paper sheets of the paper sheet stack on the sheet stack tray 28 to the sheet feed roller pair 30. If a plurality of paper sheets are sent out, the sheet feed roller pair 30 separates only the uppermost paper sheet among the plurality of paper sheets and transports the same to the transport roller pair 26.

Figure 3:
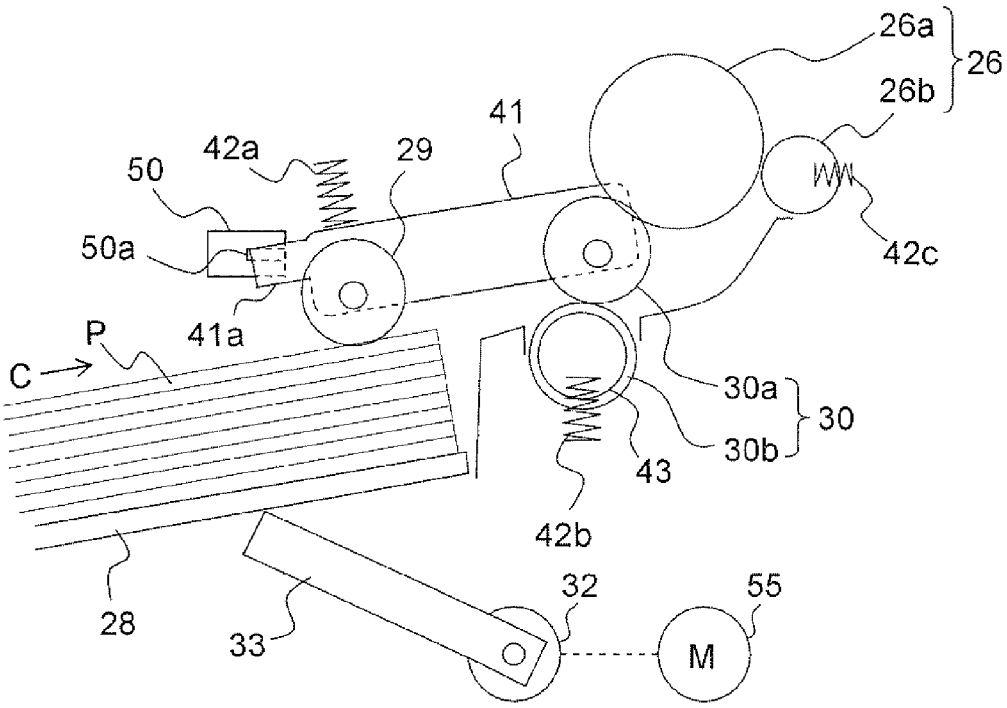
FIG. 3 is a schematic diagram illustrating a pickup roller and its vicinity in the sheet feeding device of the present disclosure.
Figure 4:
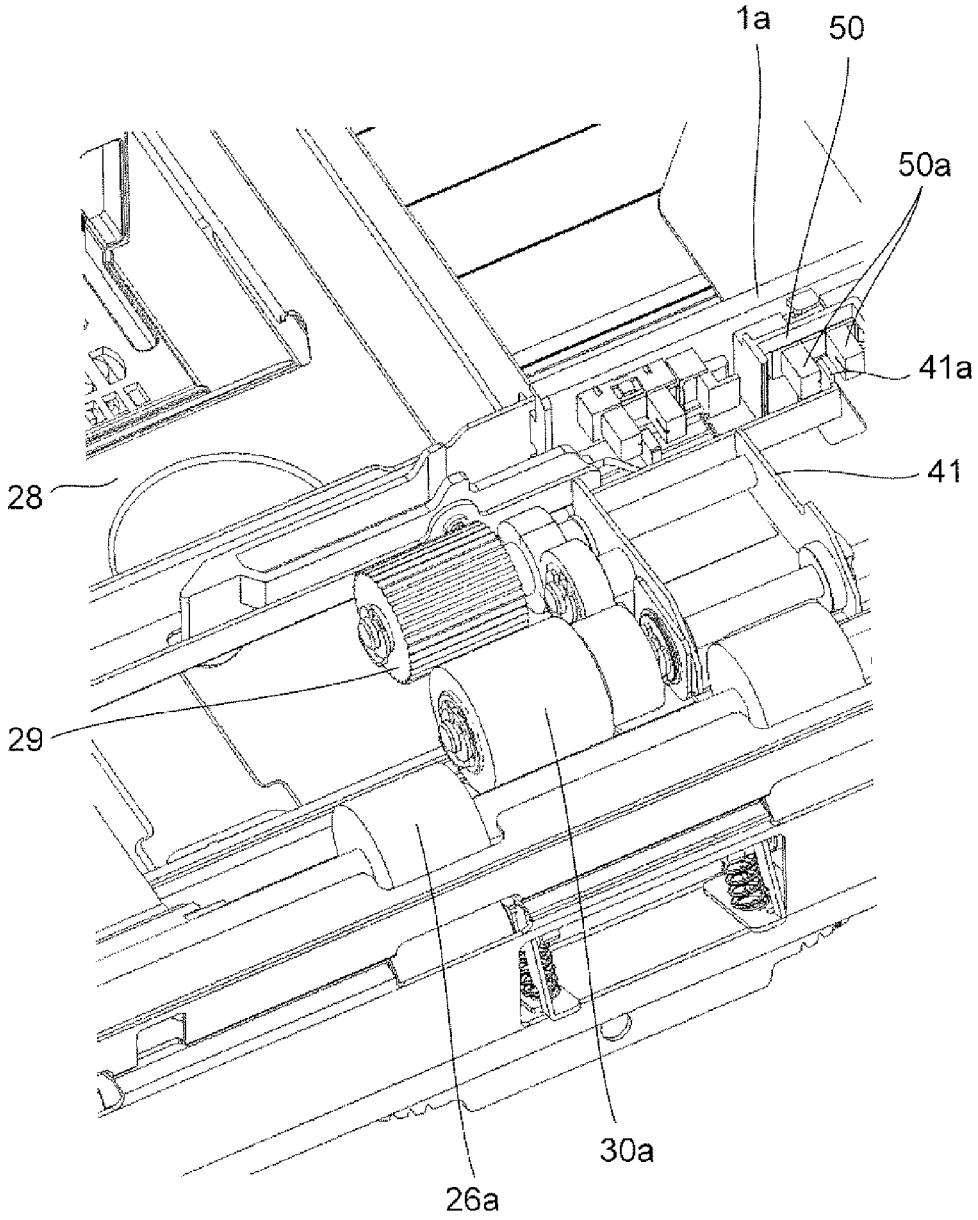
FIG. 4 is a perspective view illustrating the pickup roller and its vicinity in the sheet feeding device of the present disclosure.

The structure of the pickup roller 29 and its vicinity is described in detail with reference to FIGS. 3 and 4. FIG. 3 is a schematic diagram illustrating the pickup roller 29 and its vicinity. FIG. 4 is a perspective view of the pickup roller 29 and its vicinity.

As illustrated in FIG. 3, the pickup roller 29 contacts with the uppermost paper sheet P of the paper sheet stack on the sheet stack tray 28 and rotates in a counterclockwise direction so as to sends out the paper sheet P to the sheet feed roller pair 30.

The sheet feed roller pair 30 includes a sheet feed roller 30*a* and a separation roller 30*b*. The separation roller 30*b* is pressed by a helical compressed spring 42*b* to contact with the sheet feed roller 30*a*, and a torque limiter 43 is embedded in it. When the sheet feed roller 30*a* is driven to rotate, the separation roller 30*b* rotates dependently so as to transport the paper sheet P to the transport roller pair 26. If a plurality of paper sheets are sent to a nip portion between the sheet feed roller 30*a* and the separation roller 30*b*, the torque limiter 43 controls the rotation of the separation roller 30*b*, so that sheet feed roller pair 30 separates only the uppermost paper sheet P among the plurality of paper sheets by the torque limiter 43 and transports the same to the transport roller pair 26. Note that it is possible to adopt a structure in which a separation pad is disposed instead of the separation roller 30*b* including a torque limiter 43.

The transport roller pair 26 includes a transport roller 26*a* and a transport collar 26*b* that is pressed by a helical compressed spring 42*c* to contact with the transport roller 26*a*. When the transport roller 26*a* is driven to rotate, the transport collar 26*b* rotates dependently so that the paper sheet P is transported to the sheet transport path 71 (see FIG. 1).

The pickup roller 29 and the sheet feed roller 30*a* are disposed apart from each other in the paper sheet transport direction C and are supported by a supporting member 41 in a rotatable manner. The supporting member 41 is supported pivotally around a rotation axis of the sheet feed roller 30*a* to swing vertically in the apparatus main body 1*a*. In addition, an end of a helical compressed spring 42*a* is connected to the upper surface of the supporting member 41 at a vicinity of the pickup roller 29, and the other end of the compressed spring 42*a* is fixed to the apparatus main body 1*a*. In this way, the supporting member 41 is forced toward the sheet stack tray 28.

Further, a protruding part 41*a* as a member to be detected is formed in an end of the supporting member 41 on the pickup roller 29 side. The protruding part 41*a* can move between a position opposed to a detecting member 50 and a position apart from the same when the supporting member 41 swings about the rotation axis of the sheet feed roller 30*a*. In addition, as illustrated in FIG. 4, the protruding part 41*a* is formed to bend from a part of the supporting member 41 extending in the width direction of the paper sheet and is disposed at the rear face portion 22*e* side of the sheet feed cassette 22 (see FIG. 2).

The detecting member 50 is fixed to the apparatus main body 1*a* at the rear face portion 22*e* side of the sheet feed cassette 22 with respect to the pickup roller 29 (see FIG. 2). The detecting member 50 has a U shape viewed from the top, and includes a detection portion 50*a* constituted of a light emitting portion and a light receiving portion disposed on opposed inner surfaces of the U shape. When the protruding part 41*a* of the supporting member 41 passes through the detection portion 50*a*, the protruding part 41*a* blocks light emitted from the light emitting portion to the light receiving portion so that the detecting member 50 can output a LO detection signal having low level. On the contrary, when the protruding part 41*a* does not block the light in the detection portion 50*a*, the detecting member 50 can output a HI detection signal having high level. When the detecting member 50 outputs the LO detection signal, it is detected that the upper surface of the paper sheets stacked on the sheet stack tray 28 is lifted to a predetermined feeding position. Note that the detecting member 50 may be constituted of a reflection type optical sensor. The reflection type optical sensor can output the LO detection signal when receiving reflected light from the protruding part 41*a* that passes to block the emitted light.

Specifically, with reference to FIG. 3 again, when a lift up/down motor 55 is driven to rotate in one direction so as to swing the lifting plate 33 upward via a gear 32, the sheet stack tray 28 is lifted, and the upper surface of the paper sheets on the sheet stack tray 28 pushes up the pickup roller 29 against the compressed spring 42*a*. When the pickup roller 29 is lifted, the supporting member 41 swings upward around the rotation axis of the sheet feed roller 30*a*. Then, the protruding part 41*a* of the supporting member 41 becomes opposed to the detection portion 50*a* of the detecting member 50 so that the detecting member 50 outputs the LO detection signal. Thus, it is detected that the upper surface of the paper sheets on the sheet stack tray 28 is in the feeding position, and drive of the lift up/down motor 55 is stopped based on this LO detection signal. Note that the lift up/down motor 55 and the lift up/down mechanism constitute a lift up/down means.

Next, the pickup roller 29, the sheet feed roller 30*a*, and the transport roller 26*a* are driven to rotate. The pickup roller 29 sends out the uppermost paper sheet P of the sheet stack tray 28 to the sheet feed roller pair 30. If a plurality of paper sheets are sent to the nip portion of the sheet feed roller pair 30, the sheet feed roller pair 30 separates only the uppermost paper sheet P and transports the paper sheet P to the transport roller pair 26, so that the transport roller pair 26 transports the paper sheet P to the sheet transport path 71 (see FIG. 1). Note that the gear rotated by the lift up/down motor 55 may be a sector gear or a worm gear.

Figure 5:
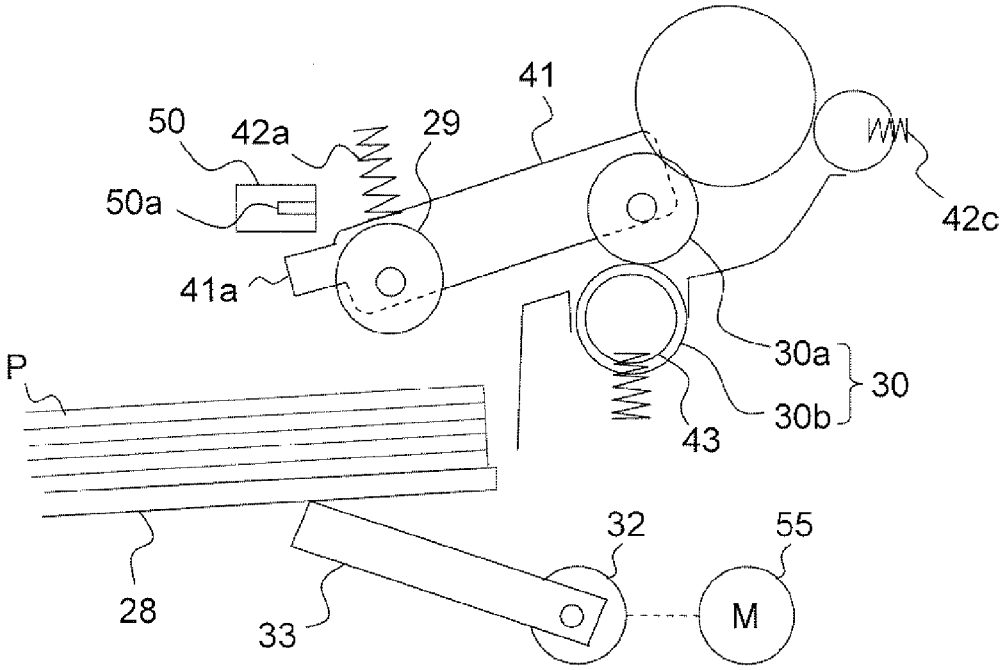
FIG. 5 is a schematic diagram illustrating a state where paper sheets on a sheet stacking member of the present disclosure are separated from the pickup roller.

FIG. 5 is a schematic diagram illustrating a state where the paper sheet P on the sheet stack tray 28 is apart from the pickup roller 29. When the paper sheet P on the sheet stack tray 28 is transported so that paper sheets on the sheet stack tray 28 are decreased, the uppermost paper sheet P on the sheet stack tray 28 becomes a non-contact state with the pickup roller 29. In this state, the supporting member 41 is retained at the lowered predetermined position, and the protruding part 41*a* of the supporting member 41 does not block a light path of the detection portion 50*a* of the detecting member 50. The HI detection signal is output from the detecting member 50, and it is detected that the upper surface of the paper sheet P on the sheet stack tray 28 does not reach the feeding position. Therefore, the lift up/down motor 55 is driven to rotate in one direction until the LO detection signal is output from the detecting member 50. Thus, the sheet stack tray 28 is lifted so that the upper surface of the paper sheets on the sheet stack tray 28 contacts with the pickup roller 29 to reach the feeding position.

Figure 6A:
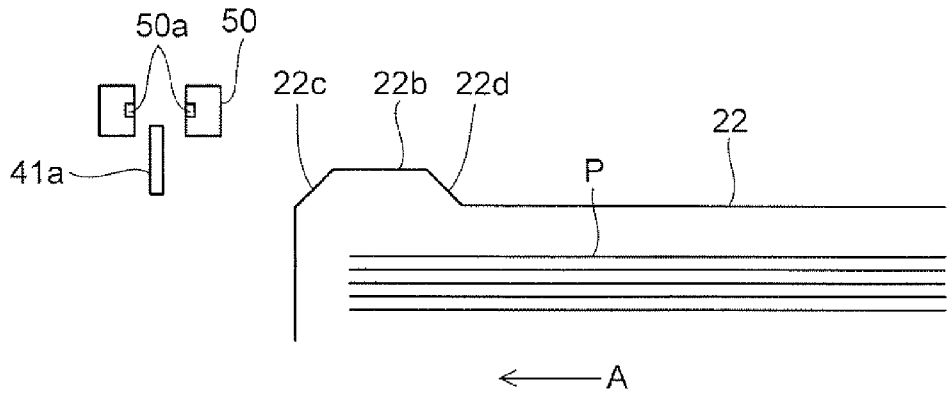
FIG. 6A is a schematic side view illustrating a starting state of attaching a sheet feed cassette of the present disclosure.
Figure 6B:
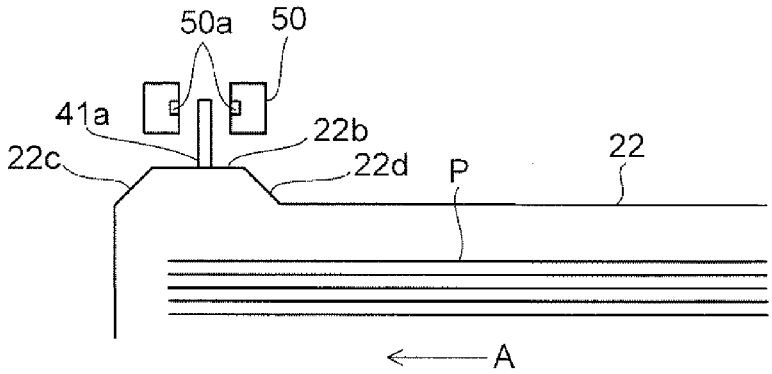
FIG. 6B is a schematic side view illustrating a halfway state of attaching the sheet feed cassette of the present disclosure.
Figure 6C:
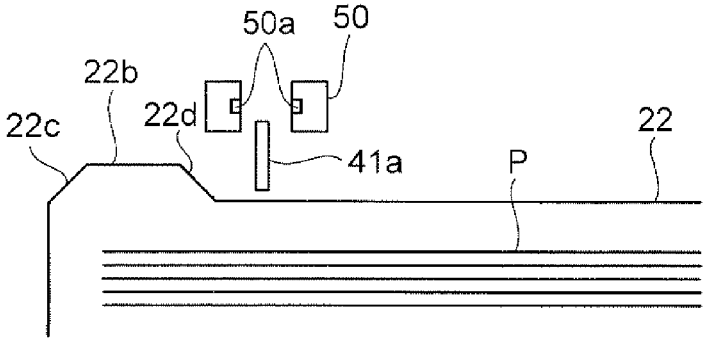
FIG. 6C is a schematic side view illustrating a completion state of attaching the sheet feed cassette of the present disclosure.
Figure 7:
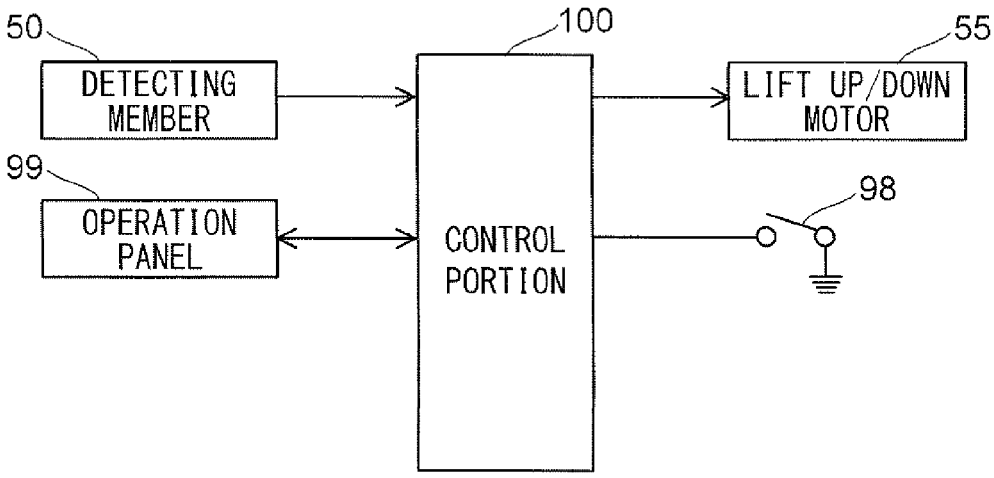
FIG. 7 is a block diagram illustrating a decision of good or bad of a detecting member and a drive control of a lift up/down motor of the present disclosure.

Next, with reference to FIGS. 6A to 6C and 7, a structure for detecting good or bad of operation of the detecting member 50 is described. FIGS. 6A to 6C are schematic side views illustrating an attaching operation of the sheet feed cassette 22. FIG. 6A illustrates a starting state of attaching the sheet feed cassette 22, FIG. 6B illustrates a halfway state of attaching the sheet feed cassette 22, and FIG. 6C illustrates a completion state of attaching the sheet feed cassette 22. FIG. 7 is a block diagram illustrating a decision of good or bad of an operation of the detecting member 50 and a drive control of the lift up/down motor 55.

As illustrated in FIG. 6, the sheet feed cassette 22 is equipped with an engaging portion 22*b*. The engaging portion 22*b* is disposed at a position such as to engage with the protruding part 41*a* of the supporting member 41 when the sheet feed cassette 22 is attached to the apparatus main body 1*a*. Specifically, the engaging portion 22*b* is disposed at the side face portion on the downstream side in the paper sheet transport direction C (see FIG. 2) in the sheet feed cassette 22 and at the end portion on the rear face portion 22*e* side (see FIG. 2). In addition, the engaging portion 22*b* protrudes upward from the side face portion of the sheet feed cassette 22. On the attaching direction A side of the engaging portion 22*b*, an end portion 22*c* is formed to extend from the engaging portion 22*b*. On the detaching direction B (see FIG. 2) side of the engaging portion 22*b*, an end portion 22*d* is formed to extend from the engaging portion 22*b*. The end portion 22*c* is formed as a slope descending toward the attaching direction A side, and the end portion 22*d* is formed as a slope descending toward the detaching direction B side. Because the engaging portion 22*b* is provided with the slopes, the protruding part 41*a* can easily move in up and down direction when the engaging portion 22*b* engages with the protruding part 41*a* or release the engagement. Note that the engaging portion 22*b* may engage with a part of the supporting member 41 disposed in a vicinity of the protruding part 41*a* instead of engaging with the protruding part 41*a* of the supporting member 41.

As illustrated in FIG. 6A, before the sheet feed cassette 22 is moved to slide in the arrow A direction (when starting to attach the sheet feed cassette 22 to the apparatus main body 1*a*), the protruding part 41*a* is located at a position apart from the detecting member 50.

As illustrated in FIG. 6B, when the sheet feed cassette 22 is moved to slide in the A direction, the end portion 22*c* of the engaging portion 22*b* pushes up the protruding part 41*a*, and a flat end portion of the engaging portion 22*b* keeps the protruding part 41*a* at a position opposed to the detection portion 50*a* of the detecting member 50. In this state, the detecting member 50 can output the LO detection signal. If the detecting member 50 outputs the LO detection signal, it means that the detecting member 50 is working normally. If the detecting member 50 does not output the LO detection signal, it means that the detecting member 50 is in an abnormal state.

Next, as illustrated in FIG. 6C, when the sheet feed cassette 22 is moved to slide until a position of completion of the attachment, the protruding part 41*a* slides and drops from the end portion 22*d* of the engaging portion 22*b* so as to be apart from the detection portion 50*a* of the detecting member 50.

Along with the movement of the protruding part 41*a* when the sheet feed cassette 22 is attached, a control portion 100 decides good or bad of operation of the detecting member 50 and controls to drive the lift up/down motor 55 after the decision.

The control portion 100 includes a microcomputer and memories such as a RAM and a ROM, and performs various operations based on a program and data stored in the RAM and the ROM, as well as data input from the detecting member 50, an attachment switch 98, an operation panel 99, and the like, and controls the operation panel 99, the lift up/down motor 55 and the like as illustrated in FIG. 7.

The attachment switch 98 outputs an ON signal to the control portion 100 when the attachment of the sheet feed cassette 22 to the apparatus main body 1*a* is completed (in the state illustrated in FIG. 6C). The control portion 100 drives the lift up/down motor 55 when the attachment switch 98 outputs the ON signal and the detecting member 50 outputs the HI detection signal. In other words, if the ON signal is not input to the control portion 100 (in the states of FIGS. 6A and 6B), the lift up/down motor 55 is not driven to rotate.

The operation panel 99 is used by a user to instruct to start image formation, to select a mode among various modes, the number of copies, and the like. The operation panel 99 can also display a selected mode and the number of copies in accordance with an instruction of the user, a warning, and the like. In this embodiment, there is a mode of displaying the warning of an abnormal state of the detecting member 50.

In this warning display mode, for example, when the sheet feed cassette 22 is attached after supplying paper sheets, in the halfway state of the attachment as illustrated in FIG. 6B, the engaging portion 22*b* of the sheet feed cassette 22 engages with the protruding part 41*a*. In the state where the engaging portion 22*b* engages with the protruding part 41*a* so that the protruding part 41*a* is opposed to the detecting member 50. Then, good or bad of operation of the detecting member 50 is decided based on whether or not the LO detection signal is output from the detecting member 50. If the LO detection signal is output to the control portion 100, the operation panel 99 displays to indicate that the detecting member 50 is in good condition. On the contrary, if the LO detection signal is not output to the control portion 100, the operation panel 99 displays the warning. In this way, good or bad of the detecting member 50 can be easily grasped before feeding paper sheets. Instead of displaying the warning on the operation panel 99, it is possible to warn with a buzzer or the like.

When attachment of the sheet feed cassette 22 is completed (in the state of FIG. 6C), the engaging portion 22*b* of the sheet feed cassette 22 is positioned apart from the protruding part 41*a*. Therefore, the protruding part 41*a* is apart from the detection portion 50*a* of the detecting member 50. Therefore, the detecting member 50 outputs the HI detection signal and the attachment switch 98 outputs the ON signal, so that the control portion 100 drives the lift up/down motor 55. When the lift up/down motor 55 is driven to rotate, the sheet stack tray 28 is lifted so that the upper surface of the paper sheets on the sheet stack tray 28 contacts with the pickup roller 29 to reach the feeding position.

In this way, when the attachment of the sheet feed cassette 22 is completed, engagement between the engaging portion 22*b* and the protruding part 41*a* is released. Therefore, it is possible to decide good or bad of operation of the detecting member 50 without being an obstacle to supplying paper sheets from the sheet feed cassette 22.

The present disclosure can be used for a sheet feeding device and an image forming apparatus including the same such as a copier, a printer, a facsimile, and a multifunction apparatus thereof In particular, the present disclosure can be used for a sheet feeding device that lifts up and down paper sheets stacked in a sheet feed cassette, and an image forming apparatus including the same.

What is claimed is:

1. A sheet material feeding device comprising:

a sheet material stacking member that can move sheet material in up and down direction;

a send-out means that is pressed to contact with the uppermost surface of the sheet material stacked on the sheet material stacking member so as to move the contact surface in a predetermined direction for sending out the sheet material;

a lifting unit that moves both upward and downward, the sheet material stacking member between a feeding position in which the uppermost surface of the sheet material contacts with the send-out means and a separate position in which the uppermost surface of the sheet material is apart from the send-out means;

a member to be detected that can move in the up and down direction when the sheet material stacking member moves;

a detecting member that can output a detection signal when the member to be detected moves to a predetermined position; and a cassette that supports the sheet material stacking member in a movable manner and can be attached and detached from an apparatus main body, the cassette having an engaging portion for moving the member to be detected to the predetermined position when being attached to the apparatus main body, wherein the lifting unit includes a lifting mechanism that moves both upward and downward, the sheet material stacking member between the feeding position and the separate position, and a lifting motor that drives the lifting mechanism, and when the member to be detected moves to the predetermined position, drive of the lifting motor is stopped.

2. The sheet material feeding device according to claim 1, wherein when the member to be detected is at the predetermined position, the sheet material stacking member is in the feeding position.

3. The sheet material feeding device according to claim 1, further comprising an alarming means that alarms an abnormal state if the detecting member does not detect the member to be detected when the cassette is attached to the apparatus main body.

4. The sheet material feeding device according to claim 3, wherein the alarming means alarms an abnormal state if the detecting member does not output the detection signal when the member to be detected moves to a predetermined position with respect to the detecting member in a halfway state of attaching the cassette to the apparatus main body.

5. The sheet material feeding device according to claim 1, wherein the engaging portion releases the movement of the member to be detected to the predetermined position when the attachment of the cassette to the apparatus main body is completed.

6. The sheet material feeding device according to claim 5, wherein the lifting unit is driven when the engaging portion releases the movement of the member to be detected to the predetermined position and the detecting member outputs a signal due to the release of the movement of the member to be detected to the predetermined position.

7. The sheet material feeding device according to claim 1, further comprising a supporting member that supports the send-out means in a rotatable manner, wherein the member to be detected is fixed to the supporting member, and the supporting member supported to be able to swing by the apparatus main body.

8. The sheet material feeding device according to claim 1, wherein the cassette can be attached and detached from the apparatus main body in a direction perpendicular to a paper sheet transport direction.

9. An image forming apparatus comprising the sheet material feeding device according to claim 1.

10. An image forming apparatus, which forms an image on a sheet material fed from a cassette including the sheet material feeding device according to claim 1.

11. A sheet material feeding device comprising:

a sheet material stacking member that can move sheet material in up and down direction;

a send-out means that is pressed to contact with the uppermost surface of the sheet material stacked on the sheet material stacking member so as to move the contact surface in a predetermined direction for sending out the sheet material;

a lifting unit that moves both upward and downward, the sheet material stacking member between a feeding position in which the uppermost surface of the sheet material contacts with the send-out means and a separate position in which the uppermost surface of the sheet material is apart from the send-out means;

a member to be detected that can move in the up and down direction when the sheet material stacking member moves;

a detecting member that can output a detection signal when the member to be detected moves to a predetermined position;

a control portion that stops drive of the lifting unit based on a detection signal output from the detecting member when the sheet material stacking member moves to the feeding position for sending out the sheet material; and a cassette that supports the sheet material stacking member in a movable manner and can be attached and detached from an apparatus main body, wherein the cassette has an engaging portion for moving the member to be detected to the predetermined position when being attached to the apparatus main body, and the control portion decides whether or not the detection signal is output from the detecting member when the engaging portion moves the member to be detected to the predetermined position.

12. The sheet material feeding device according to claim 11, wherein the control portion controls an alarming means to alarm an abnormal state if it is decided that the detection signal is not output from the detecting member.

13. The sheet material feeding device according to claim 11, wherein the engaging portion moves the member to be detected to the predetermined position in a halfway state of attaching the cassette to the apparatus main body, and the engaging portion releases the movement of the member to be detected to the predetermined position when the attachment of the cassette to the apparatus main body is completed.

14. The sheet material feeding device according to claim 13, wherein the control portion controls an alarming means to alarm an abnormal state if the detecting member does not output the detection signal when the member to be detected moves to a predetermined position with respect to the detecting member.

15. The sheet material feeding device according to claim 13, wherein the control portion drives the lifting unit if the detecting member outputs a signal due to the release of the movement of the member to be detected to the predetermined position.

* * * * *